US006311411B1

(12) United States Patent
Clark

(10) Patent No.: US 6,311,411 B1
(45) Date of Patent: Nov. 6, 2001

(54) VERTICAL DRYER WITH VERTICAL PARTICLE REMOVAL PLENUM AND METHOD OF USE

(75) Inventor: Douglas Clark, Sabetha, KS (US)

(73) Assignee: Wenger Manufacturing Inc., Sabetha, KS (US)

( * ) Notice: Subject to any disclaimer, the term of this patent is extended or adjusted under 35 U.S.C. 154(b) by 0 days.

(21) Appl. No.: 09/543,596

(22) Filed: Apr. 5, 2000

(51) Int. Cl.[7] ..... F26B 3/00

(52) U.S. Cl. ..... 34/507; 34/174; 34/178; 34/211; 34/228; 34/487

(58) Field of Search ..... 34/487, 498, 507, 34/168, 171, 174, 178, 211, 228

(56) References Cited

U.S. PATENT DOCUMENTS 3,896,562 * 7/1975 Zimmerman ..... 34/174
4,043,051 * 8/1977 Lussenden ..... 34/77
4,392,310 * 7/1983 Hohman et al. ..... 34/172
4,914,834 * 4/1990 Sime ..... 34/169
5,167,081 * 12/1992 Loyns ..... 34/179
5,243,767 * 9/1993 Stein ..... 34/359
5,893,218 * 4/1999 Hunter et al. ..... 34/492

OTHER PUBLICATIONS

Wenger Bulletin "Wenger Cascade Dryer", No. CD699 (1999), Wenger Manufacturing, Inc.

* cited by examiner

*Primary Examiner*—Pamela Wilson
(74) *Attorney, Agent, or Firm*—Hovey, Williams, Timmons & Collins

(57) ABSTRACT

An vertical dryer (10) is provided having a plurality of individual dryer decks (12–18) including alternating fan and heater decks (14, 16), an air circulation assembly (11), and an upright, common plenum chamber (26) in communication with the decks (12–18). The assembly (11) is operable to create a continuous drying air stream which passes upwardly in countercurrent flow relationship to product on the decks (12–18). Also, the assembly (11) serves to pass the drying air stream into, through and out of the plenum (26) at the level of each heater deck (16); in the plenum (26), the air stream velocity is decreased, causing particulate fines to fall out of the stream for collection. The use of the common plenum (26) also allows independent control of the decks (12–18) in terms of air flows therethrough and recirculation characteristics.

15 Claims, 8 Drawing Sheets

VERTICAL DRYER WITH VERTICAL PARTICLE REMOVAL PLENUM AND METHOD OF USE

BACKGROUND OF THE INVENTION

1. Field of the Invention

The present invention is broadly concerned with vertical, multiple-deck continuous batch dryers designed for drying of pellets and other similar products. More particularly, the invention pertains to such dryers and drying methods wherein the dryers have a series of superposed, air-pervious drying decks and an air circulation assembly operable to generate and direct a continuous drying air stream through the decks; a common upright plenum chamber is provided adjacent and in communication with the dryer decks, and the air circulation assembly is designed to pass the air stream into, through and out of the plenum chamber as the air stream passes through respective decks. This allows easy removal of entrained fines within the drying air stream and also permits the user to individually control both the air flow and the percentage of air recirculation through each deck, independently of the other decks.

2. Description of the Prior Art

Multiple-deck vertical continuous batch dryers have been used in the past for drying of pellets and other agricultural and food products. A vertical design allows product transfer between decks with good product separation. Moreover, a higher degree of moisture uniformity is achieved owing to multiple turning of the product as it passes between the vertically spaced decks. The countercurrent design of these dryers (product descends and air flows move upwardly) also gives higher energy efficiencies.

Several different design approaches have been tried in the past with vertical dryers. In one system, each deck assembly is provided with a separate fines collection unit in the form of a cyclone separator, fan and heater. This approach does have the virtue of removing fines at each deck level, thus minimizing the tendency for fines to accumulate on internal dryer components. However, this is a very expensive expedient, with the multiple fines collection units greatly increasing equipment costs and necessary plant space. In another system, only a single collection device is provided at the upper outlet of the dryer. This significantly reduces costs, but does not remove fines at each dryer stage. Thus, it is necessary to have increasing air velocities from bottom to top of the dryer in order to insure that the fines remain entrained in the drying air stream for ultimate separation at the final collector.

Furthermore, both of these prior art approaches suffer from the inability to effectively and efficiently control dryer operation at each deck, independently of the other decks. This means that the air flows (velocities) through each deck cannot be independently controlled, nor can the amount of air recirculation at each deck be controlled.

There is accordingly a real and unsatisfied need in the art for an improved vertical dryer which avoids the high costs associated with multiple collector type dryers, while at the same time giving the same or a better degree of staged fines removal. Also, there is a need for a vertical dryer wherein the individual decks thereof can be independently controlled in terms of airflow velocities and recirculation characteristics.

SUMMARY OF THE INVENTION

The present invention overcomes the problems outlined above, and provides an improved vertical dryer which comprises a plurality of superposed, air-pervious drying decks which support quantities of product to be dried thereon and which are selectively openable to allow the product quantities to descend from deck-to-deck during drying thereof. The dryer also includes an air circulation assembly operable to generate and direct a continuous drying air stream through the respective decks and the product quantities thereon. The vertical dryer of the invention also includes an upright, common plenum chamber adjacent and in communication with the drying decks, such air circulation assembly being operable to pass the continuous air stream into, through and out of the plenum chamber as the air stream passes between respective decks. Such traversal through the plenum chamber facilities fines removal and also allows independent deck control.

In preferred forms, the plenum chamber is sized so that when the drying air stream passes into and through the chamber it loses substantial velocity, which facilities drop-out of suspended fines. Furthermore, a series of diverters are located within the plenum chamber for redirecting the air flow through the chamber. The plenum preferably has a particle collector adjacent the lower end thereof.

The air circulation assembly includes a plurality of individually controllable fan units which can be adjusted to provide independent control of the velocity of the drying air stream as the latter passes through individual decks. Such fan units typically comprise a fan and an adjacent, selectively openable and closeable damper. Alternately, variable speed fans can be employed.

DETAILED DESCRIPTION OF THE PREFERRED EMBODIMENT

Figure 1:
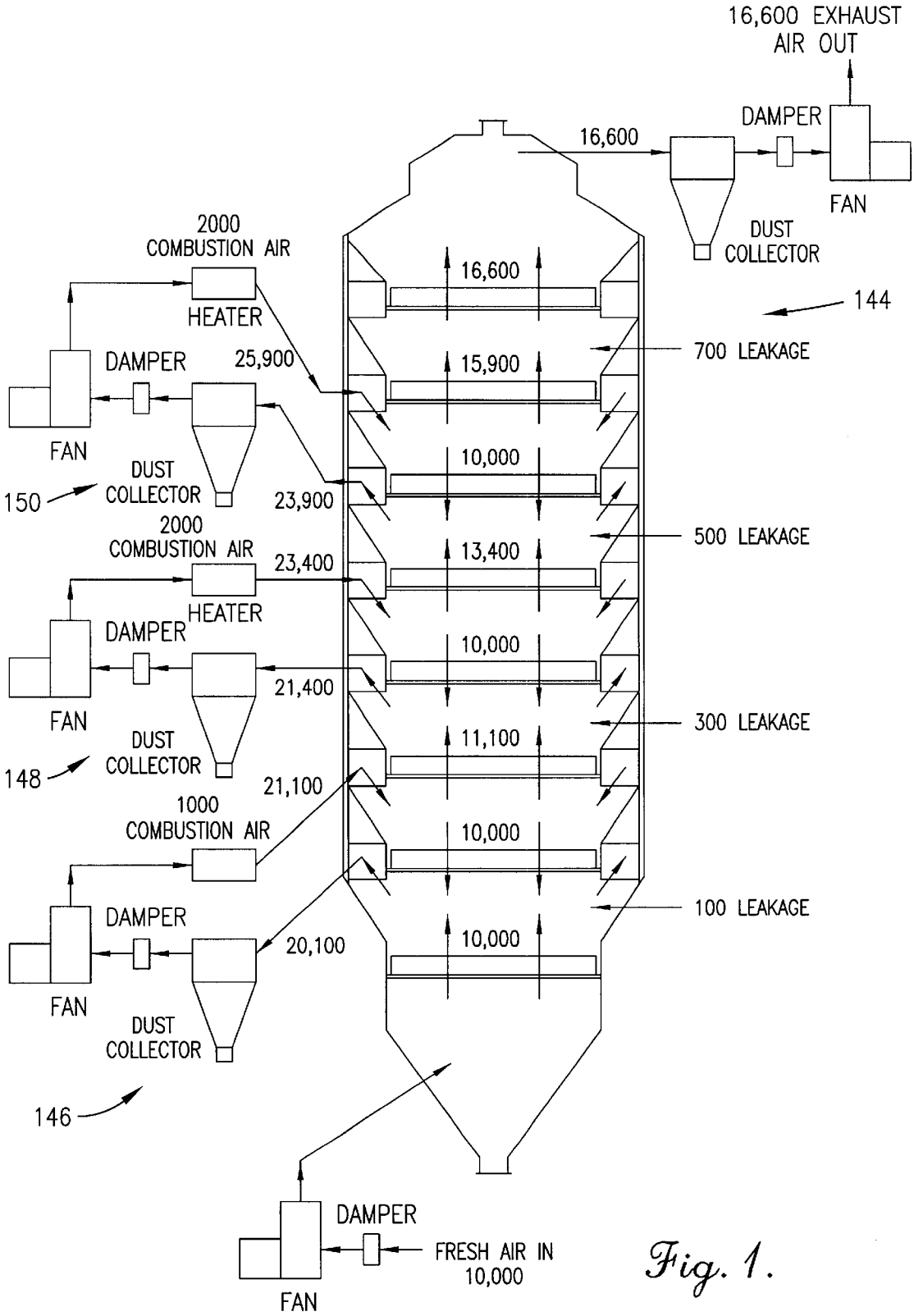
Fig. 1. PRIOR ART
FIG. 1 is a schematic side view of a prior art vertical dryer wherein each drying zone includes an individual cyclone collector for fines removal.

Turning now to the drawings, and particularly FIGS. 4–7, a vertical dryer 10 in accordance with the invention is illustrated. The exemplary dryer 10 is made up of a total of eight superposed, vertically spaced apart decks (although a less or greater number of decks could be used), and a multiple-fan air circulation assembly broadly referred to by the numeral 11 associated with the dryer decks. The dryer 10 has an uppermost inlet deck 12 six alternating fan and heater decks 14 and 16, and an optional lower cooling deck 18. Each set of decks 14, 16 provides a drying zone, and thus the depicted dryer 10 has three such zones. The inlet deck 12 is surmounted by a product inlet housing 20 having a product inlet 22, while product collection hopper 24 is located beneath cooler deck 18. The overall dryer 10 also includes an upright, vertically oriented, common plenum chamber 26 supported by and communicating with the decks 12–18. The dryer 10 is designed to receive quantities of product through inlet 22 and to dry such product by successive passage of quantities thereof through the decks 12–18 for ultimate collection in hopper 24 and delivery to other downstream equipment (not shown).

Figure 7:
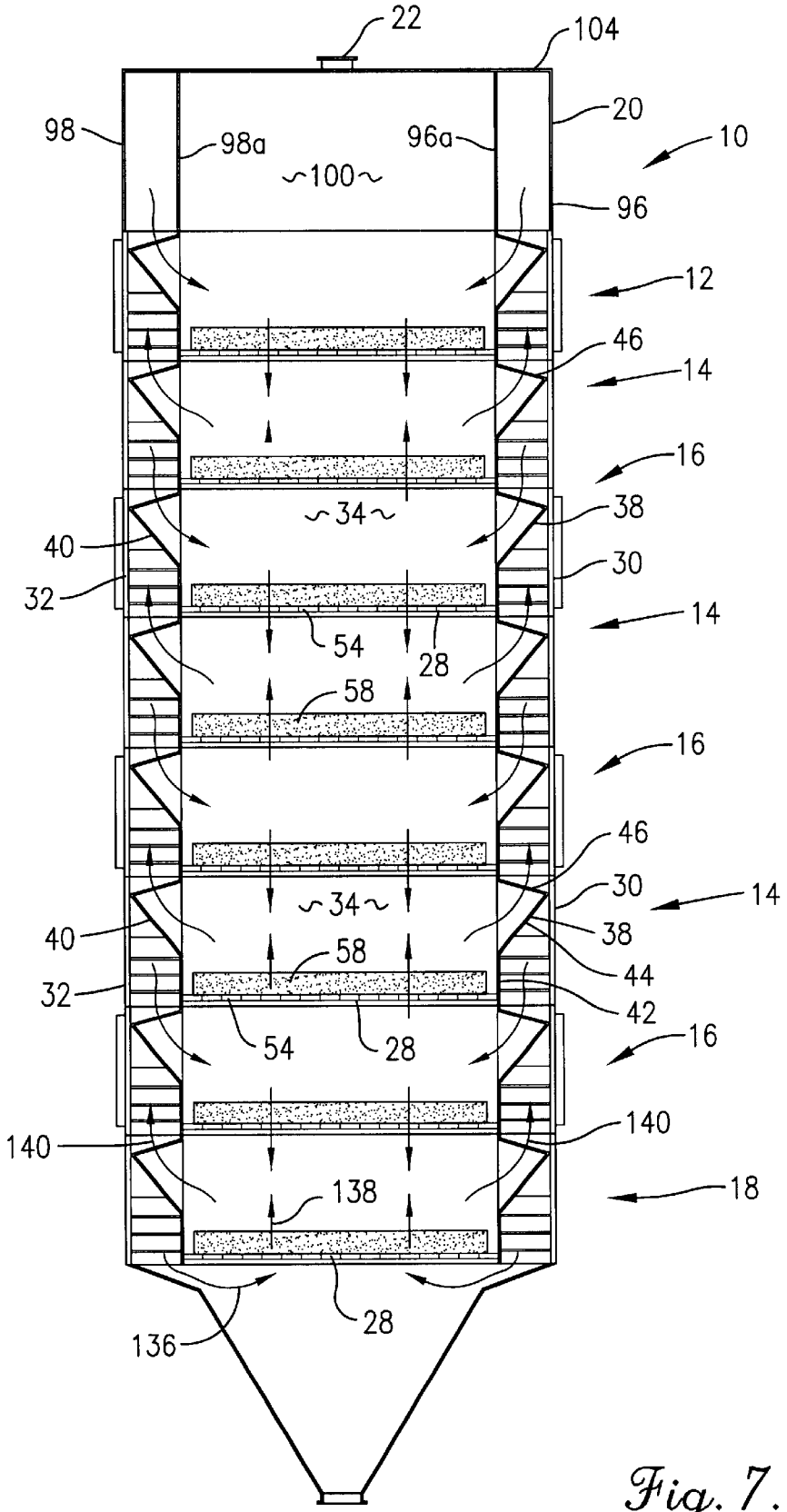
FIG. 7 is a vertical sectional central view taken along line 7—7 of FIG. 4 and illustrating other air-conveying passageways of the vertical dryer decks.

Inasmuch as all of the fan decks 14 are identical to each other, a description of a single fan deck will suffice for all; likewise, given that all of the heater decks 16 are identical to each other, only a single description thereof is provided. Each fan deck 14 includes a substantially flat, air-pervious floor 28 (FIG. 7) as well as upright outboard sidewalls 30, 32, front wall 34 and rear wall 36. In addition, a pair of upright inboard walls 38 and 40 are located adjacent the sidewalls 30, 32. As illustrated in FIGS. 7, the walls 38, 40 extend from sidewall 34 for a majority of the length of the deck 14, but are shortened to leave a rear space 41 which is important for purposes to be described. A depending wall 41*a* extends from the top of the deck downwardly and is affixed to the butt ends of the walls 20, 32 and 38, 40. Each wall 38, 40 includes a vertical segment 42, an outwardly extending segment 44, and a perforated inturned return segment 46.

Figure 4:
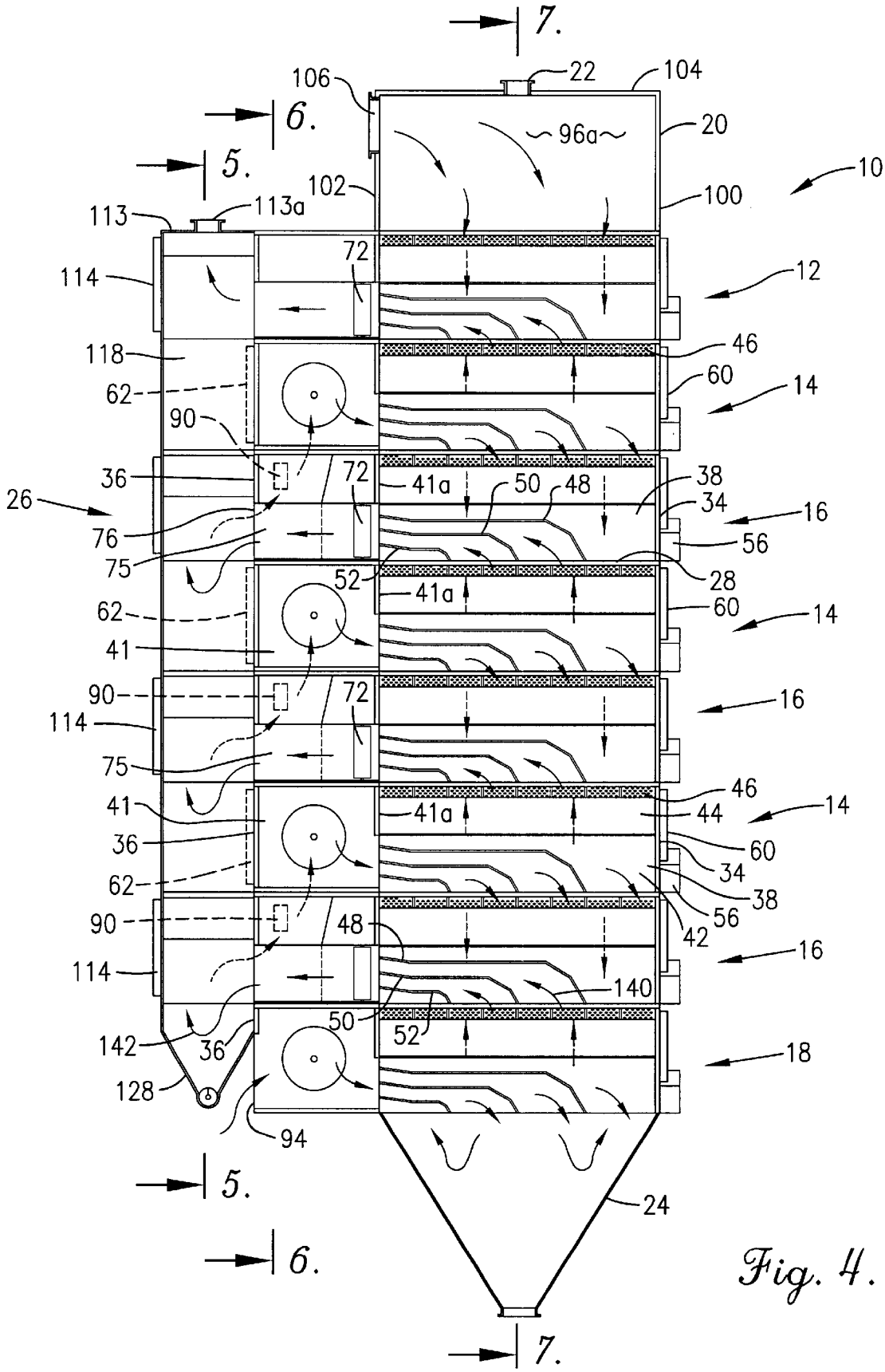
FIG. 4 is a vertical sectional side view taken along line 4—4 of FIG. 3 and showing air flows and air-directing structure associated with the preferred dryer decks and upright plenum of the invention.

As best seen in FIGS. 4 and 7, the spaces between the walls 30, 38 and 32, 40 beneath the segments 44 houses a plurality of elongated arcuate vane members 48, 50, 52. The vane members cooperatively define a total of four air passageways which are open along the bottom margin of the deck and at the rear ends thereof.

The floor 28 is made up of a plurality of elongated, side-by-side, pivotally moveable slats 54. The floor 28 is selectively openable via a conventional drive 56 (FIG. 4) coupled with the floor slats 28. When the floor 28 is in its closed position depicted in FIG. 7, it is operable to support a quantity of product 58 thereon but is nevertheless air-pervious. However, when the drive 56 is actuated the floor slats 54 are pivoted to an open position, thereby allowing the product 58 to descend under the influence of gravity onto the next lower deck.

In order to provide access to the internal components of the fan deck, front and rear access doors 60, 62 are provided.

Figure 6:
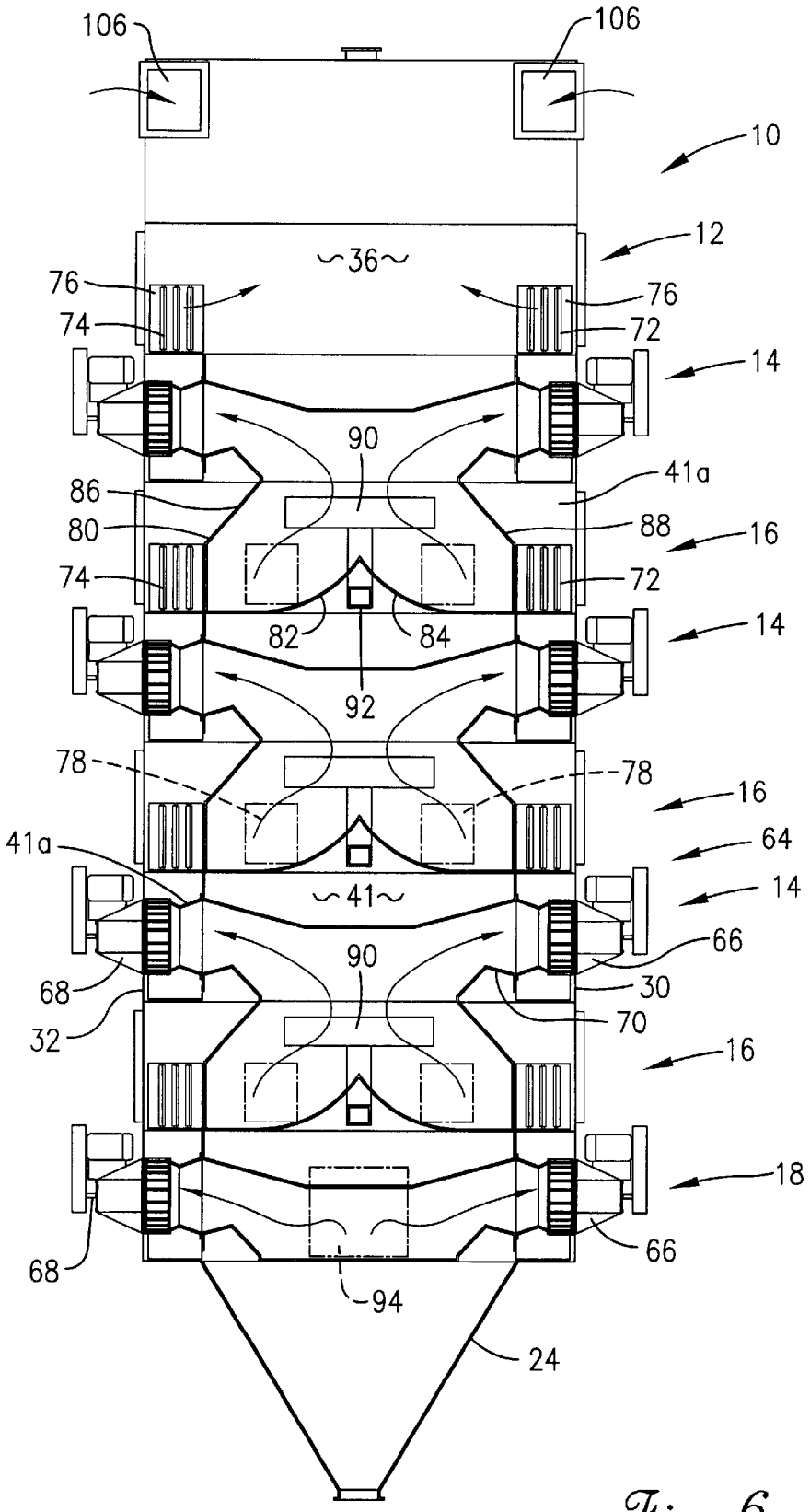
FIG. 6 is a vertical sectional rear view taken along line 6—6 of FIG. 4 and depicting certain of the air-conveying passageways associated with the vertical dryer decks.

Referring next to FIG. 6, it will be seen that a double fan assembly 64 is housed within the space 41. In particular, the assemble 64 includes a pair of powered fans 66, 68 respectively mounted in the sidewalls 30, 32. A somewhat Y-shaped duct 70 extends from the base of deck 14 upwardly to the inlet sides of the fan 66, 68. The outlet sides of the fans in turn communicate with the passageways defined by the vanes 48–52 extending along each side of the deck.

Each heater deck 16 is in many respects similar to the fan decks 14, and thus the same reference numerals are applied to like parts. Each fan deck 14 includes a floor 28, outer sidewalls 30, 32, front wall 34, rear wall 36, inner sidewalls 38, 40, internal space 41, short wall 41*a*, and vanes 48–52. Moreover, the deck 28 is made up of slats 54 moveable via drive 56. However, the heater decks 16 differ from the fan decks 14 (see FIG. 6) by provision of dampers 72, 74 at the outlets of the air passageways, as well as box-like ducts 75 extending from the dampers 72, 74 and communicating with outboard side openings 76 provided in rear wall 36. In addition, the wall 36 includes a pair of inboard openings 78. The deck 16 also includes a bifurcated duct 80 which includes a pair of lower, arcuate, converging segments 82, 84 and side segments 86, 88. The duct 80 communicates with the inboard openings 78 and is open at the upper margin of the deck 16. A heater 90 is situated within the duct 80, and is typically gas fired. The heater 90 is coupled to a combustion air inlet conduit 92 which leads to atmosphere.

The inlet deck 12 is identical with each of the heater decks 16, except that the inlet deck has no duct 80 or heater 90. While this deck is equipped with the outboard openings 76, it does not have the corresponding inboard openings 78 of the decks 16.

The cooler deck 18 is identical with each of the fan decks 14 with the exception that the rear wall 36 thereof has a central fresh air inlet opening 94 formed therein. As noted previously, provision of a cooler deck is optional.

The product inlet housing 22 is located atop inlet deck 12 and is designed to house a conventional rake or other spreader device (not shown) serving to level incoming product delivered via inlet 22. The housing 20 includes upright sidewalls 96, 98, front wall 100, rear wall 102 and top wall 104. In addition (see FIG. 7) a pair of inner walls 96*a*, 98*a* are provided adjacent corresponding sidewalls 96, 98. A pair of uppermost air inlet openings 106 are provided in rear wall 102 and communicate with the regions between the walls 96, 96*a* and 98, 98*a*.

Figure 3:
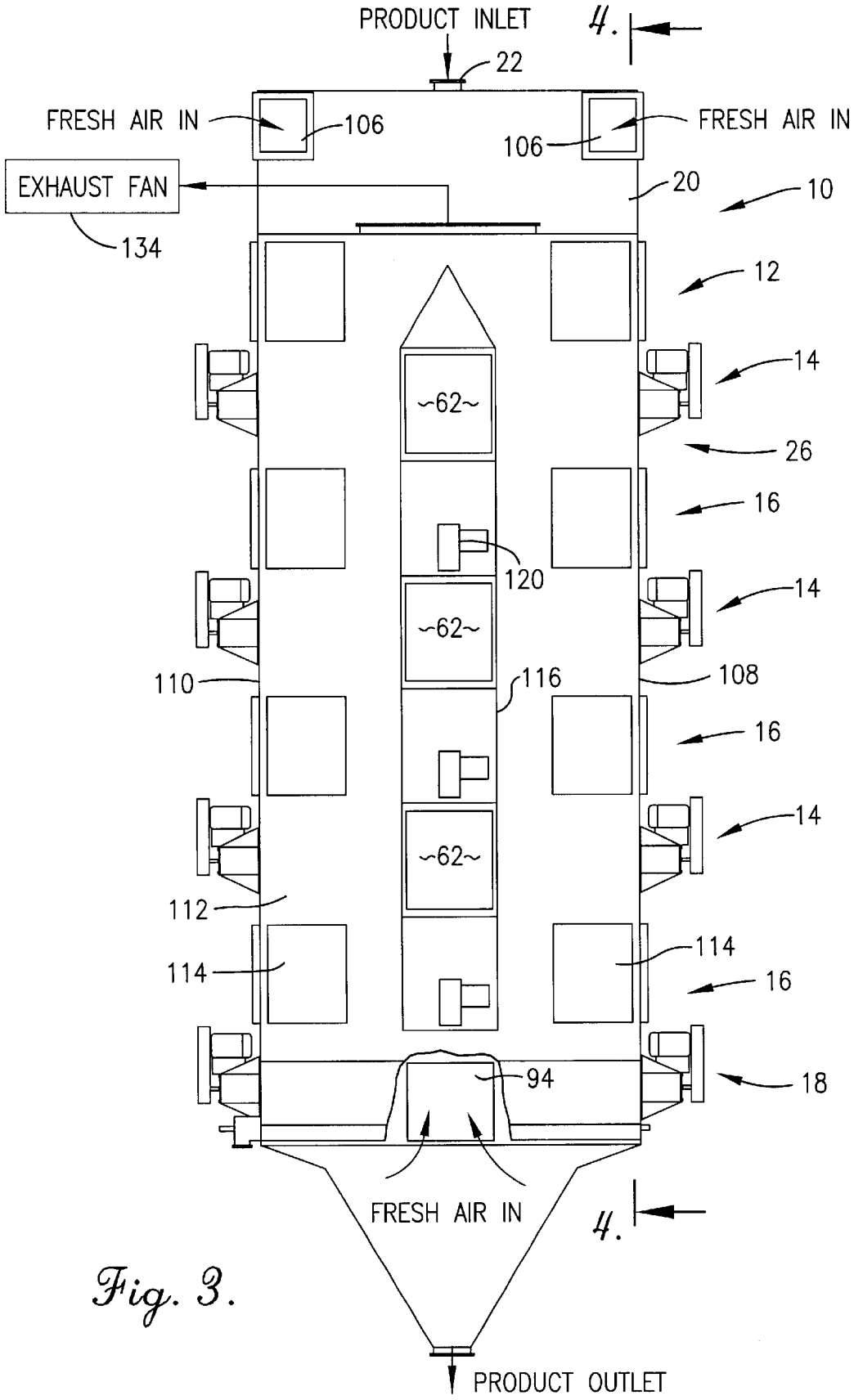
FIG. 3 is a rear schematic view with parts broken away of the improved vertical dryer of the invention.

The plenum 26 is located adjacent the rear walls of the decks 12 and 14–16. The plenum has rearwardly projecting sidewalls 108, 110 (FIG. 3) as well as a rear wall 112 and top wall 113, the latter having an outlet 113*a* formed therein. The rear wall 112 is equipped with a pair of access doors 114 at the level of each heater deck 16. Moreover, the rear wall 112 has an elongated, central, vertically extending recess 116 therein allowing access to the central doors 62 associated with the fan decks 14. Inwardly extending walls 118 define the recess 116 and are connected with plenum rear wall 112 and the rear walls 36 of the decks. A powered combustion air fan 120 is operatively coupled with each of the conduits 92 within.

Figure 5:
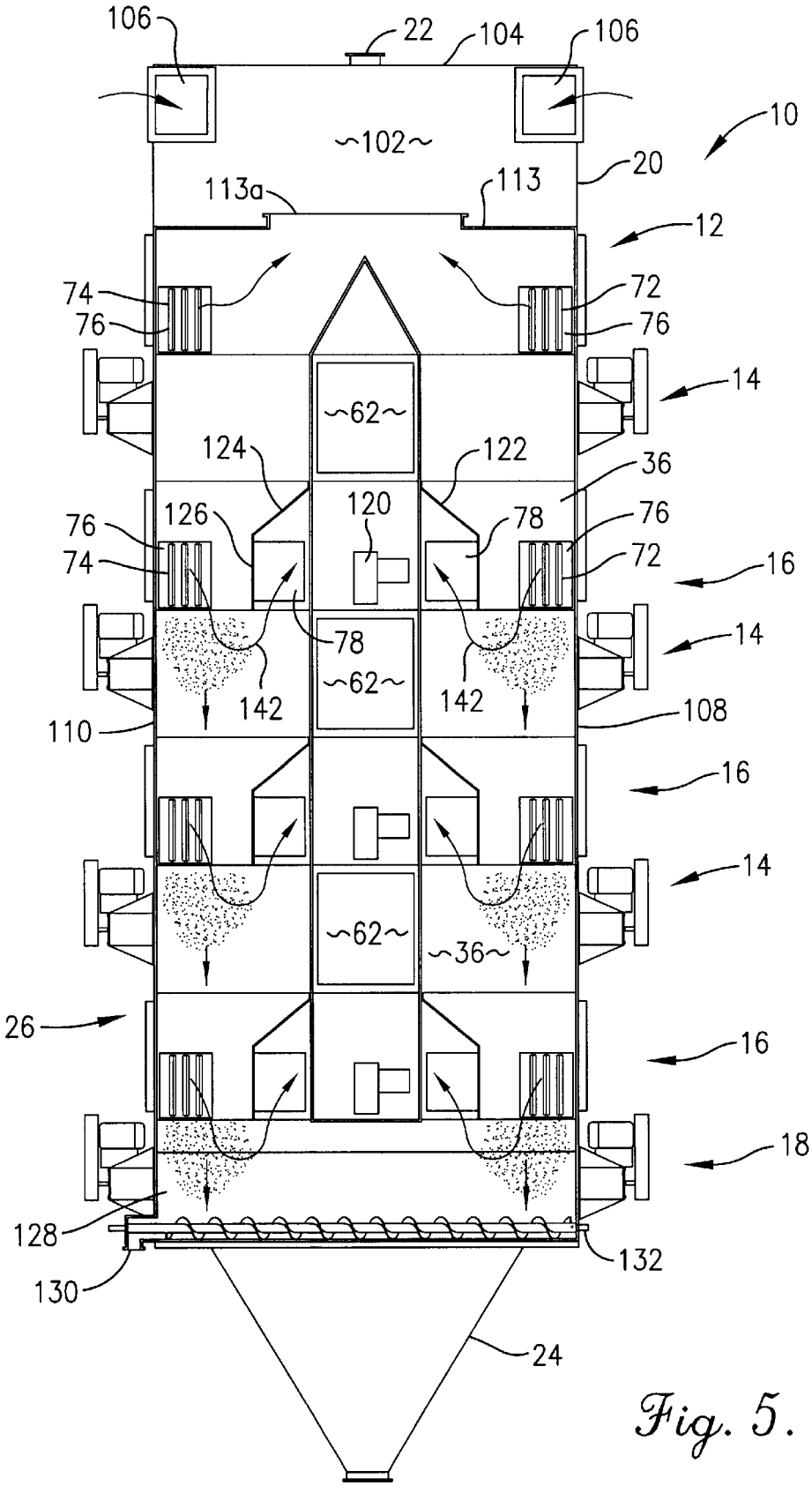
FIG. 5 is a vertical sectional rear view taken along line 5—5 of FIG. 4 and illustrating the construction of the preferred upright plenum chamber.

The plenum 26 is equipped with a series of diverters 122 which are located adjacent each of the inboard openings 78 associated with the heater decks 16. Referring to FIG. 5, it will be observed that each of the diverters includes an oblique segment 124 as well as a depending wall segment 126.

Finally, the plenum 26 includes a lowermost collection hopper 128 presenting a fines outlet 130 as well as an elongated, axially rotatable fines conveying auger 132.

The outlet 113*a* of the plenum 26 is coupled to a conventional exhaust fan 134; if desired, an additional cyclone separator may be employed to insure the separation of any fines or dust entrained within the outlet air from the plenum.

In operation, product (e.g., pellets) are delivered to the dryer 10 via inlet 22 and are initially leveled on the floor of inlet deck 12. During the drying process, individual quantities of the product are delivered to each of the decks in serial order so that, during continuous operation, individual quantities are supported on each of the decks 12–18. This condition is illustrated in FIG. 7.

Considering the operation of the dryer 10 during such continuous drying, it will be seen that fresh air is drawn into cooler deck 18 by the associated fans 66, 68, this air being directed by the vanes 48–50 to a point below the floor 28.

This air is then directed upwardly through the deck floor and the quantity of product situated thereon (see arrows 136, 138). When the fresh air passes through this product, it is drawn upwardly through the perforated return segments 46 of the deck 18 whereupon it enters the vane-defined passageways of the next above heater deck 16 (arrows 140, FIG. 7). This air is then drawn rearwardly by the fans 66, 68 of the next above fan deck 14 through the dampers 72, 74, along the box ducts 75 and through the openings 76 to enter the plenum 26 (arrows 142, FIG. 5). Given that the plenum presents a much greater volume, the velocity of the air traversing the plenum is greatly reduced, thereby facilitating dropout of fines from the air stream. Moreover, the air from the openings 76 is forced to traverse a tortuous path owing to the presence of the diverters 122. The air from the plenum chamber passes back into the deck 16 through the inboard openings 78, where it is conveyed by the duct 80 through the heater 90 and, in a heated condition, to the duct 70 of the next-above fan deck 14. Also, additional combustion air as needed is delivered by the fan 120 through conduit 92 into the heater 90, which combustion air thus joins the air stream.

It will thus be appreciated that the continuous air stream created in the dryer 10 passes upwardly from deck-to-deck, being successively heated as required in the heater decks 16 and with supplemental combustion air being added. Air drawn into each deck as leakage through the deck structure is also added to the continuous air stream. At the upper end of the dryer 10, at the level in inlet deck 12, fresh inlet air is drawn through the openings 106 by the fans 66, 68 of the highest fan deck 14, such air passing downwardly through the product on the inlet deck. Also at the inlet deck 12, the drying air stream passes through the uppermost outboard opening 76 into the plenum 26 for ultimate passage through outlet 113*a*.

The described circulation of air through the dryer 10 creates a situation where air is drawn in opposite directions through adjacent decks. Thus, air is drawn upwardly through the cooler deck 18, while air is draw downwardly through the next-above heater deck 16. This alternating pattern continues throughout the full height of the vertical dryer 10.

Figure 8:
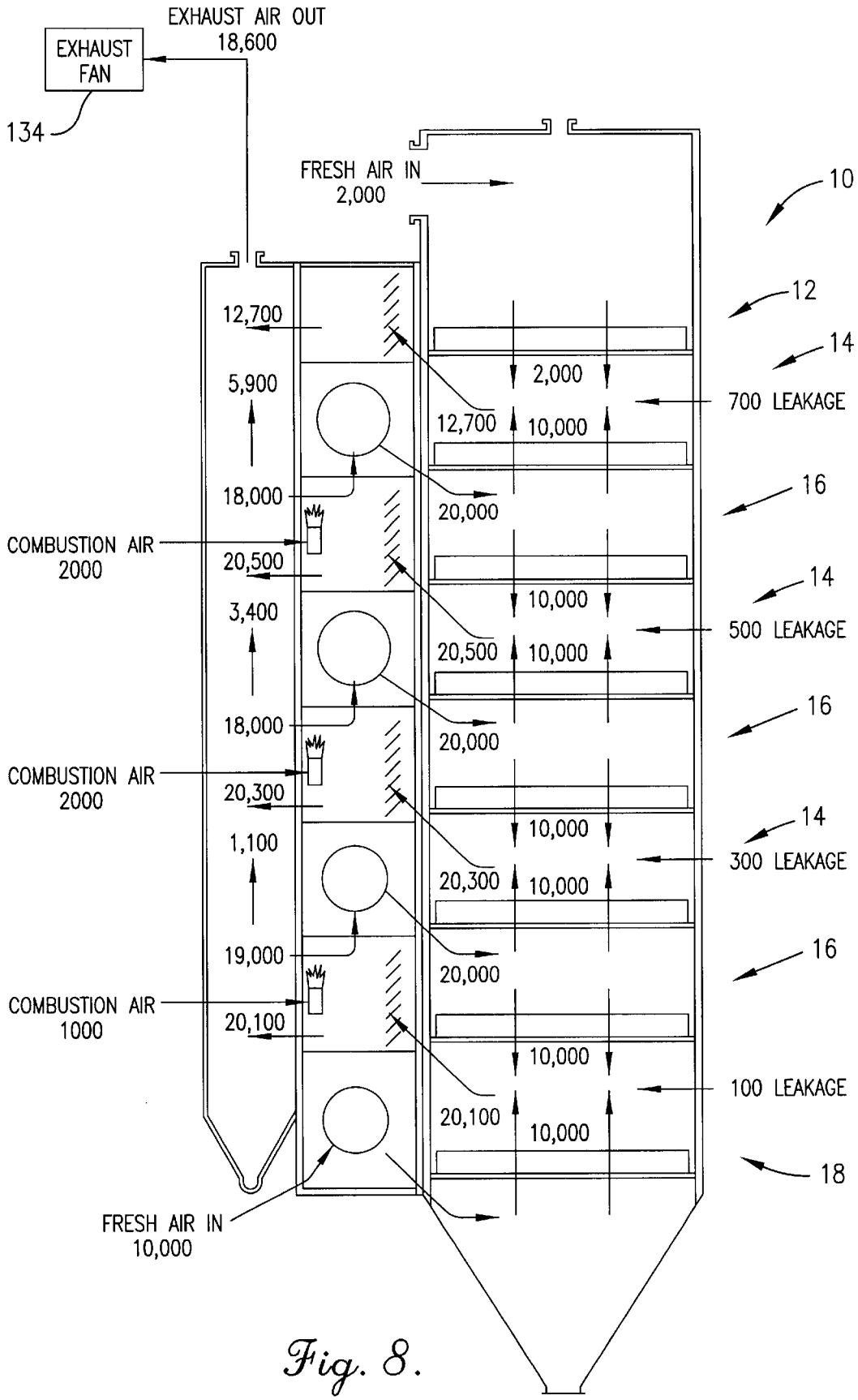
FIG. 8 is a schematic side view of the improved vertical dryer of the invention, shown with exemplary air flows throughout the height of the dryer.

Attention is next directed to schematic FIG. 8 which illustrates exemplary air flows during the operation of the dryer 10. In this example, all air flows are in cubic meters per hour ($m^3/h$). As shown, fresh air at the rate of 10,000 $m^3/h$ is draw into the bottom of the dryer 10 by the cooler deck fans; this air passes upwardly through the cooler deck to a point above the product thereon. The fan in the next higher fan deck 14 is set to draw air at the rate of 20,100 $m^3/h$ from the region above cooler deck 18. This is to accommodate 100 $m^3/h$ leakage at the cooler deck, and also to achieve a 10,000 $m^3/h$ air flow downwardly through the next-above heater deck 16. The 20,100 $m^3/h$ air flow then passes through the plenum 26 and thence through the heater 90 of the deck 16. At this point, the needed combustion air, in this example 1,000 $m^3/h$, is drawn by the fan 120 of the deck 16 into the heater.

Given that in this example the user wishes to maintain a 10,000 $m^3/h$ air flow through each of the decks, it is necessary for the fans 66, 68 of the next-above deck 14 to deliver 20,000 $m^3/h$, i.e., this air flow is split 10,000/10,000 $m^3/h$ between the two adjacent decks. This being the case, the fan is set to draw 19,000 $m^3/h$ of air from the plenum 26, which with the 1,000 $m^3/h$ of combustion air provides the necessary 20,000 $m^3/h$. The excess air (1,100 $m^3/h$) simply passes upwardly through the plenum for ultimate exhaust through outlet 113*a*.

This same pattern is thus repeated throughout each of the deck pairs throughout the height of the dryer 10, so that, at each deck a 10,000 $m^3/h$ air flow is maintained and excess air is exhausted through the plenum outlet. This is an important advantage provided by the present invention. That is, by selective fan and/or damper control, it is possible to individually regulate the air flow and recirculation through respective decks. Such precise control has heretofore not been obtainable in vertical dryers. Moreover, the ability to economically remove fines and other particulates from the drying air stream also represents a significant advance in the art.

Figure 2:
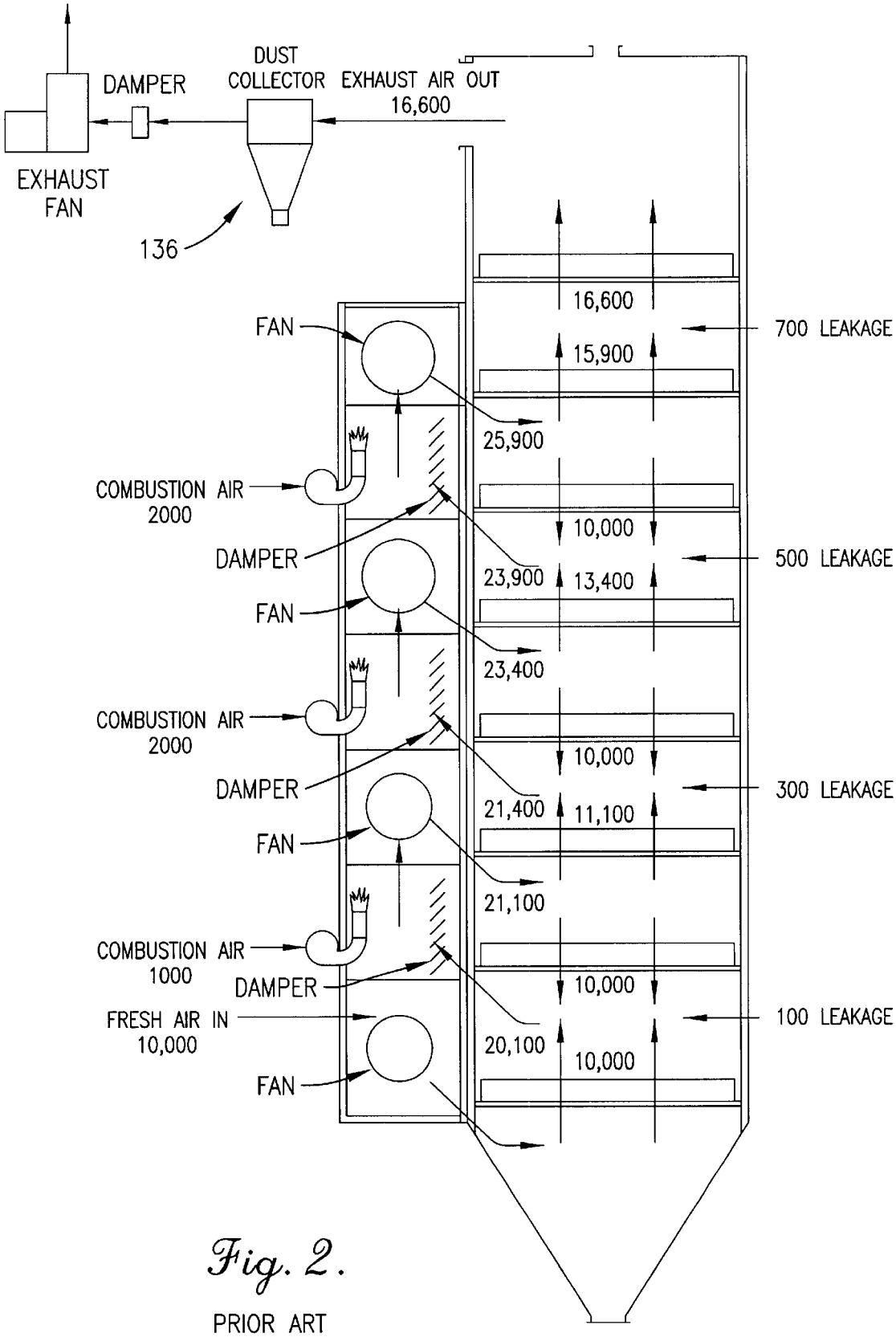
Fig. 2. PRIOR ART
FIG. 2 is a schematic side view of another prior art vertical dryer employing only a single exhaust air cyclone collector for fines removal.

These important differences can best be understand by a consideration of the prior art designs depicted in FIGS. 1 and 2. In FIG. 1, a multiple-deck vertical dryer 144 is provided which has an individual cyclone dust collector assembly 146, 148 and 150 associated with corresponding dryer decks. While this approach does remove fines at each deck level, it is disadvantage for a number of reasons. Provision of separate collectors greatly increases costs and requires more plant space. In addition, and again referring to the exemplary air flows given in FIG. 1, it will be seen that air flows generally increase from top to bottom, with a 10,000 $m^3/h$ air flow at lower levels and culminating in a 16,600 $m^3/h$ air flow at the dryer outlet. Thus, larger collection equipment is needed from bottom to top of the dryer because greater quantities of air are being handled at the upper decks.

In the FIG. 2 prior art system, use of individual dust collection assemblies is avoided, there being only a single assembly 136 to treat the exhaust air from the dryer. While this design is less costly than that shown in FIG. 1, there is no fines removal at each deck, which may result in fines accumulation in internal components unless the system is carefully designed and maintained. Further, this system suffers from the same increasing air flow from bottom to top described in connection with the FIG. 1 dryer.

It will thus be seen that the present invention provides cost and operational advantages which cannot be duplicated in prior art systems. These advantages are derived from the use of a multiple-deck vertical dryer having a common upright plenum and an air circulation assembly whereby the air circulation assembly operates to pass the continuous drying air stream into, through and out of the plenum chamber as the air stream passes between respective decks.

I claim:

1. In a vertical dryer including a plurality of superposed, air-pervious drying decks which support quantities of product to be dried thereon and which are selectively openable to allow the product quantities to descend from deck-to-deck during drying thereof, and a drying air circulation assembly operable to generate and direct a continuous drying air stream through said decks and the product quantities thereon, the improvement which comprises an upright, common plenum chamber in communication with said decks, said air circulation assembly operable to pass said air stream into, through and out of said plenum chamber as the air stream passes between respective decks.

2. The dryer of claim 1, said plenum chamber including a diverter for changing the direction of said air stream during passage of the air stream there-through.

3. The dryer of claim 2, including a particle collector adjacent the lower end of said plenum chamber.

4. The dryer of claim 1, said air circulation assembly including a plurality of individually controllable, vertically spaced apart fan units permitting independent control of the velocity of said air stream as the air stream passes through individual decks.

5. The dryer of claim 4, each of said fan units comprising a fan and an associated, selectively openable and closeable damper.

6. The dryer of claim 1, said plenum chamber having an exhaust air outlet adjacent the upper end thereof, said air circulation assembly constructed for passage of said air stream through said plenum outlet.

7. The dryer of claim 6, including a dust collector operably coupled with said plenum outlet.

8. The dryer of claim 1, said air circulation assembly operable to pass said air stream into, through, and out said plenum chamber at a plurality of vertically spaced locations along the height of the plenum chamber.

9. In a method of drying product in a vertical dryer including a plurality of superposed, air-pervious drying decks which support quantities of products to be dried thereon, the method including the step of generating and directing a continuous drying air stream through said decks and the product quantities thereon, the improvement which comprises providing an upright, common plenum chamber in communication with said decks, and passing said air stream into, through and out of said plenum chamber as the air stream passes between respective decks.

10. The method of claim 9, including the step of decreasing the velocity of said air stream during said passage of said air stream therethrough in order to cause suspended particles to drop out of the air stream within the plenum chamber.

11. The method of claim 10, including the step of collecting particles adjacent the lower end of the plenum chamber.

12. The method of claim 9, including the step of independently controlling the velocity of said air stream as the air stream passes through individual decks.

13. The method of claim 12, said independent control step comprising the step of passing the air stream through respective dampers associated with corresponding individual decks.

14. The method of claim 9, said plenum chamber comprising an exhaust outlet adjacent the upper end thereof, including the step of exhausting said air stream through said plenum outlet.

15. The method of claim 9, including the step of passing said air stream into, through and out of said plenum chamber at a plurality of vertically spaced locations.

* * * * *